United States Patent [19]

Awano

[11] Patent Number: 4,744,562

[45] Date of Patent: May 17, 1988

[54] STRING PROTECTOR FOR A RACKET

[75] Inventor: Tetsuyuki Awano, Hamamatsu, Japan

[73] Assignee: Nippon Gakki Seizo Kabushiki Kaisha, Japan

[21] Appl. No.: 865,252

[22] Filed: May 19, 1986

[30] Foreign Application Priority Data

May 28, 1985 [JP] Japan ..... 60-079820[U]

[51] Int. Cl.[4] ..... A63B 49/14

[52] U.S. Cl. ..... 273/73 D

[58] Field of Search ..... 273/73 R, 73 D, 73 C, 273/73 H, 73 K; 24/140

[56] References Cited

U.S. PATENT DOCUMENTS

| | | | |
|---|---|---|---|
| 1,423,900 | 7/1922 | Agutter | 273/73 K |
| 2,178,588 | 11/1939 | Kleinman | 273/73 D |
| 3,502,331 | 3/1970 | Lacoste | 273/73 D |
| 3,642,283 | 2/1972 | Wilkens | 273/73 D X |
| 3,866,870 | 2/1975 | Nicholson et al. | 273/73 D X |

FOREIGN PATENT DOCUMENTS

| | | | |
|---|---|---|---|
| 446157 | 3/1949 | Italy | 24/140 |
| 309238 | 4/1929 | United Kingdom | 273/73 D |

*Primary Examiner*—Richard C. Pinkham
*Assistant Examiner*—Matthew L. Schneider
*Attorney, Agent, or Firm*—Lerner, David, Littenberg, Krumholz & Mentlik

[57] ABSTRACT

A racket includes a head portion having a peripheral notch located therein. A string protector comprised of a connecting section having first and second resilient tongues is situated within the peripheral notch. Each of the tongues has an elongated projection extending therefrom such that the projections oppose each other. The connecting section also has tubular string guides extending therefrom for receiving a racket string. The force of the racket strings tends to push the string protector into the peripheral notch of the head portion, thereby forcing the resilient tongues toward each other so as to close over the strings.

4 Claims, 2 Drawing Sheets

STRING PROTECTOR FOR A RACKET

BACKGROUND OF THE INVENTION

The present invention relates to an improved string protector for a racket, and more particularly relates to an improvement in construction of a string protector used for the head of a tennis or badminton racket.

In the general construction of a tennis racket, for example, a number of string holes are formed through the head of the racket in a direction substantially parallel to the face and a substantially U-shaped notch is formed between adjacent string holes in the outer periphery of the head. A string protector made of synthetic resin is placed tight in the notch in order to protect the turn back section of an associated string to be exposed on the outer side of the head whilst extending between the adjacent string holes. The string protector includes a connecting section of a U-shaped transverse cross section which extends between adjacent string holes and a pair of tubular string guides projecting in one body from the rear face of the connecting section. When the string protector is placed tight in the notch, the connecting section is reseived in the notch and the string guides are received in the adjacent string holes. When an associated string is set in stretch to the head of the racket, tension on its turn back section presses the string protector to the inner wall of the notch.

Since the string is deeply received in the protector, the string is placed out of direct impulsive contact with the ground. However, presence of the open residual space in the string protector allows easy direct contact of the string with small stones and the like coming into the residual space. Such contact often causes damage of the string exposed to the residual space. Further, such an open residual space is apt to disturb flow of ambient air to increase pneumatic resistance when the racket is swung during play. Increased pneumatic resistance mars the speed of swing at hitting balls and generates keen, harsh noizes.

In order to avoid such troubles, it is proposed to cover a string with a tape or to close the residual space with a lid after setting of the string to the head of the racket. By such expedient, intrusion of small stones or the like and increase in pneumatic resistance may be more or less obviated. It is, however, troublesome for players to set such attachments to the racket. In addition, such simple attachments are liable to fall when the racket is swung greatly during play.

SUMMARY OF THE INVENTION

It is one object of the present invention to provide a string protector able to fully shield a string against attack by small stones or the like.

It is another object of the present invention to provide a string protector which generates no keen and harsh noizes at swing of the racket.

In accordance with the basic aspect of the present invention, a string protector includes a pair of facing tongues elongated along its connecting section which are closable towards each other when the connecting section is pressed against the inner wall of a notch receiving the string protector.

DESCRIPTION OF THE PREFERRED EMBODIMENTS

Figure 1:
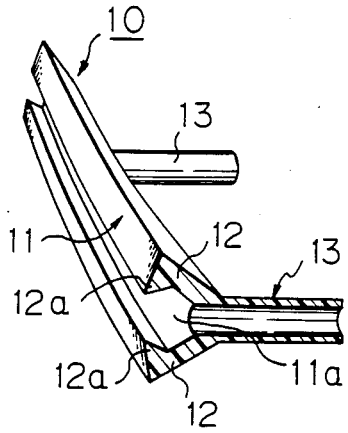
FIG. 1 is a perspective view, partly in section, of one embodiment of the string protector in accordance with the present invention.
Figure 2:
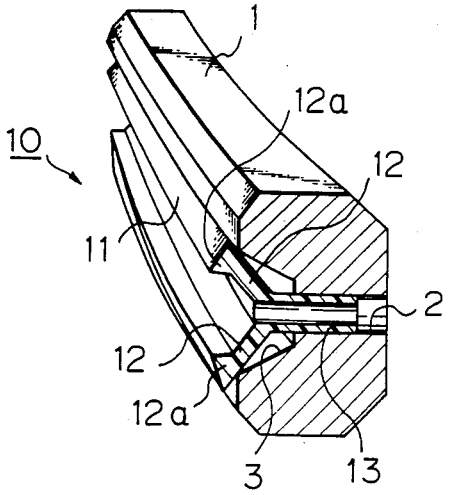
FIG. 2 is a perspective view, partly in section of the string protector shown in FIG. 1 in a state set in the notch of a racket before setting of a string.

One embodiment of the string protector in accordance with the present invention is shown in FIG. 1, in which the string protector 10 is made of synthetic resin. The string protector 10 includes a pair of facing tongues 12 extending along its connecting section 11. At the distal ends, the tongues 12 are provided with pawls 12*a* facing each other. The string protector 10 is further provided with tubular string guides 13 which open in the residual space 11*a* between the pair of tongues 12 of the connecting section 11. The pawls 12*a* of the tongues 12 are spaced from each other such that, when the string protector 10 is placed in the peripheral notch 3 of the head 1 of the racket as shown in FIG. 2, the distal ends of the string protector 10 abut against the dikes of the notch 3 and the bottom of the connecting section 11 is kept out of contact with the bottom inner wall of the notch 3. In this state, the string guides 13 are incompletely received in associated string holes 2 in the head 1 of the racket.

Figure 3:
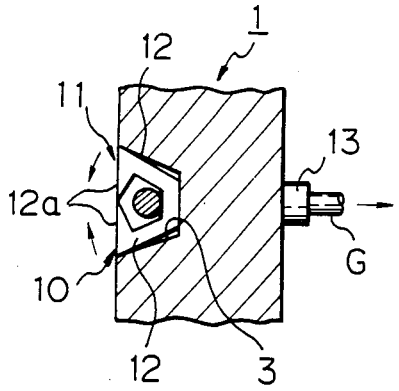
FIG. 3 is a sectional view of the string protector in a state after setting of the string in tension.

When a string G is set to the head 1 under this condition, the string protector 10 as a whole is strongly and fully pressed against the inner wall of the notch 3 due to the string tension and, due to forced contact with the inner wall of the notch 3, resiliency of the synthetic resin allows the tongues 12 to close towards each other until their pawls 12*a* are brought into mutual contact as shown in FIG. 3. As a consequence, the turn back section of the string G is fully embraced by the string protector 10. So no stones or the like are allowed to come in direct touch with the turn back section of the string G. Further, as the residual space is also fully covered by the string protector 10, no pneumatic resistance is increased even at quick swing of the racket.

Figure 4:
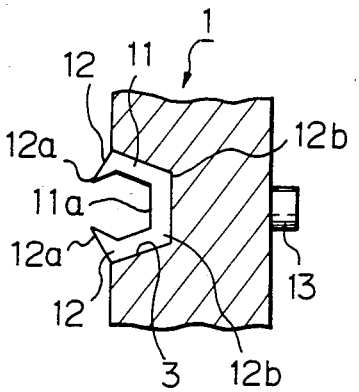
FIG. 4 is a sectional view of another embodiment of the string protector in accordance with the present invention in a state set in the notch of a racket before setting of a string.
Figure 5:
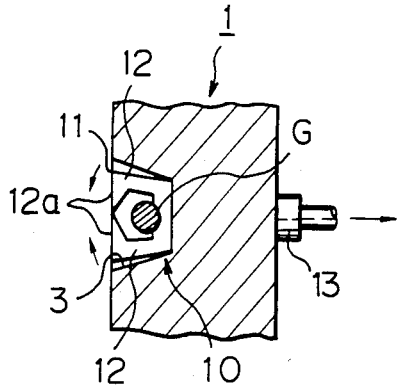
FIG. 5 is a sectional view of the string protector in a state after setting of the string in tension.

In the case of the foregoing embodiment, the pair of tongues 12 are squeezed towards each other through the forced contact with the inner wall of the notch 3. In the embodiment shown in FIG. 4, a pair of deformable shoulders 12*b* are formed at both bottom corners of the connecting section 11 so that string tension should cause closure of the tongues 12 as shown in FIG. 5.

Since the string protector 10 can be firmly set to the head of the racket when the string is set thereto, it is no longer required for the players to incur the additional trouble of setting tapes or lids. As long as the string is set to the head in tension, the string protector does never fall out of the notch.

What is claimed is:

1. A stringed racket comprising a frame head having a peripheral notch for receiving a string under tension, at least one string exposed in said notch, and a connecting section received into said notch, said connecting section including first and second resilient tongues attached to and extending along said connecting section, each of said first and second resilient tongues having an elongated projection thereon forming a string receiving space between said tongues, said elongated projections opposing each other, said connecting section being drawn into said notch by the tension of said string such that said tongues move toward each other causing said elongated projections to be brought into close proximity with each other thereby substantially covering said string within said string receiving space.

2. The string protector of claim 1 where in each of said pair of resilient tongues is constructed so that said resilient tongues contact opposing inner sidewalls of said notch upon placement of said connecting section into said notch, the opposing inner sidewalls urging said resilient tongues towards each other in response to said string tension thereby substantially covering said string within said string receiving space.

3. The string protector of claim 1 wherein said connecting section further includes deformable shoulder members formed at the bottom corners of said connecting section, whereby said string tension causes said tongues to move towards each other to substantially cover said string within said string receiving space.

4. The string protector of claim 1 further including at least one tubular string guide extending through the bottom of said connecting section, said guide having a passage therethrough opening into said string receiving space.

* * * * *